United States Patent [19]

Henk

[11] Patent Number: 4,532,500

[45] Date of Patent: Jul. 30, 1985

[54] WEB TENSION AND BREAK SENSOR SYSTEM FOR PHOTOSENSITIVE WEB PROCESSORS

[75] Inventor: Keith L. Henk, Brooklyn Park, Minn.

[73] Assignee: Pako Corporation, Minneapolis, Minn.

[21] Appl. No.: 414,426

[22] Filed: Sep. 2, 1982

[51] Int. Cl.[3] ..... G08B 19/00

[52] U.S. Cl. ..... 340/675; 226/11; 226/25; 242/57; 354/321; 340/668

[58] Field of Search ..... 340/668, 675, 686; 200/61.13; 354/321, 322; 226/11, 25; 242/57, 75.43, 75.44

[56] References Cited

U.S. PATENT DOCUMENTS

| | | | |
|---|---|---|---|
| 2,048,182 | 7/1936 | Ybarrondo | 226/11 X |
| 2,555,949 | 6/1951 | Wilson | 340/675 |
| 2,688,125 | 8/1954 | Mills | 340/668 |
| 2,727,226 | 12/1955 | Giskes et al. | 340/668 |
| 4,067,035 | 1/1978 | Plursch et al. | 354/321 X |
| 4,099,193 | 7/1978 | Leuchter et al. | 354/321 |

*Primary Examiner*—James L. Rowland
*Assistant Examiner*—Brian R. Tumm
*Attorney, Agent, or Firm*—Kinney & Lange

[57] ABSTRACT

A sensing system senses web movement and web tension of a photosensitive web moving through a processor. The system includes a sensing arm pivotally attached about a pivot to the processor and a transport roller rotatably attached to one end of the sensing arm. The photosensitive web engages the transport roller such that the roller rotates. The other end of the sensing arm, on an opposite side of the pivot point, is biased in a direction opposing the web tension of the photosensitive web. A tension detecting mechanism detects the movement of the sensing arm when the web tension overcomes the biasing force and transmits an alarm signal indicating that the web tension has increased beyond a predetermined value. A web break detecting mechanism is preferably included and detects the rotation of the transport roller and transmits a signal when the transport roller stops rotating indicating that a web break has occurred.

2 Claims, 9 Drawing Figures

Fig.1
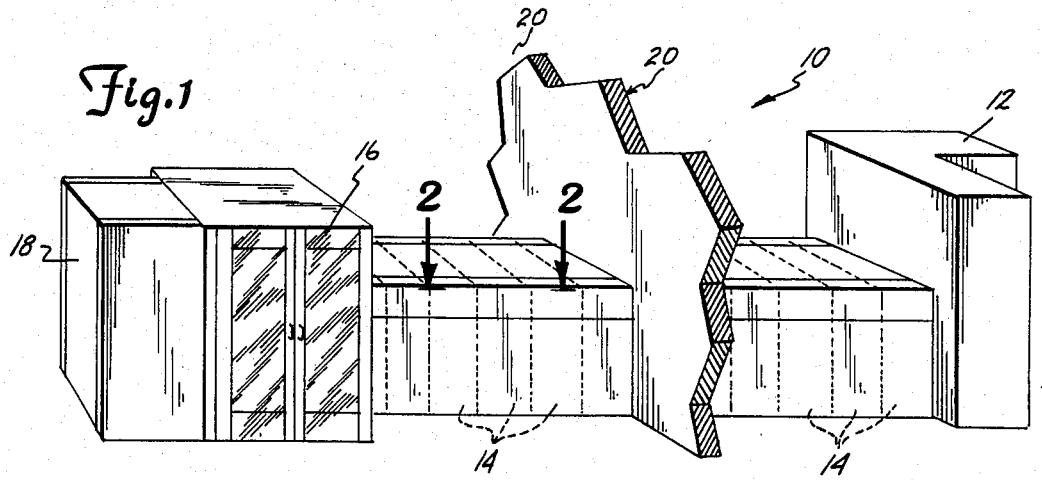
Fig.2
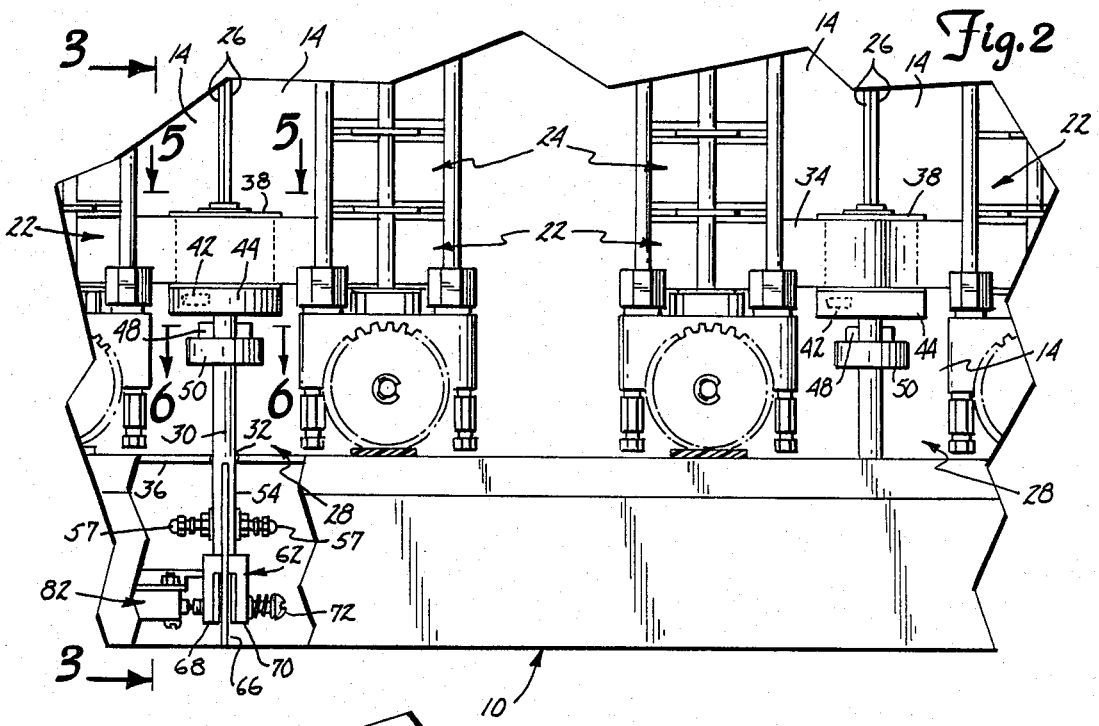
Fig.5
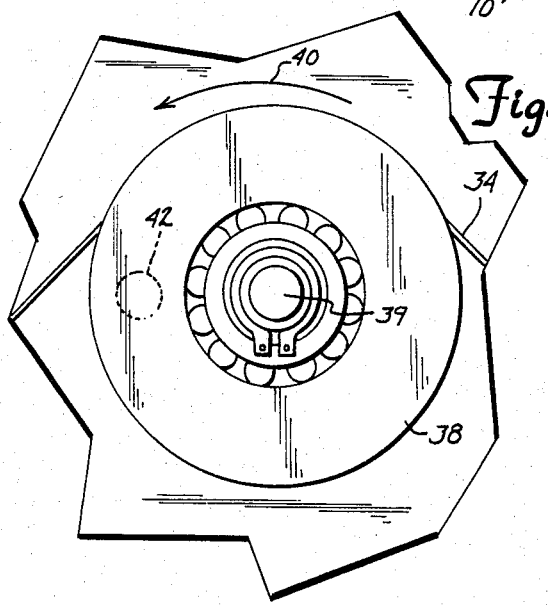
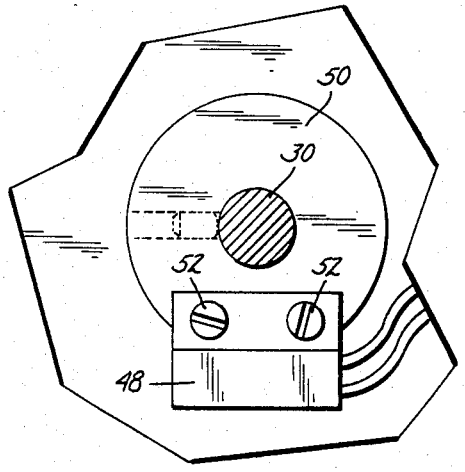
Fig.6

WEB TENSION AND BREAK SENSOR SYSTEM FOR PHOTOSENSITIVE WEB PROCESSORS

BACKGROUND OF THE INVENTION

1. Field of the Invention

The present invention relates to sensor systems that sense web tension and web movement in processors of photosensitive web.

2. Description of the Prior Art

In photofinishing, it is typical to continuously process long webs of photosensitive material by transporting the web through a series of processing tanks which contain different chemical solutions, and then through a dryer that dries the web. Both photographic film and photographic print paper are commonly processed in this manner.

In the case of photographic film, it is typical to splice together individual strips of undeveloped photographic film for processing. Cine processor machines are used to develop continuously the long web of photographic film formed by splicing the individual strips of film.

In a cine processor, the film web is transported through the tanks by sets of transport rollers on transport racks having an upper set and a lower set of rollers. The film enters the transport rack on one side and is transported in a helical manner between the upper and the lower rollers of the rack until it reaches the outside of the rack where it is transferred to the next transport rack.

As is easily apparent, a malfunction such as a film break results in costly down time and possible damage to the photosensitive film web. The Rawlings U.S. Pat. No. 4,344,073 granted on Aug. 10, 1982 and assigned to the same assignee as the present application, discloses a film break detector in a photographic film dryer. The apparatus disclosed in U.S. Pat. No. 4,344,073 works quite well in detecting a film break in a dryer. However, a further improvement in the art of sensing web breaks in photographic processing equipment would be to forecast such breaks before they occurred and wherein such a system would operate in a dryer or in a chemical tank. Advanced warning of the film breaks would provide the operator with time to correct the problem and avoid possible damage to the photosensitive web.

SUMMARY OF THE INVENTION

The present invention is an improved sensing system that senses web movement and web tension of a photosensitive web moving through a processor. The improved sensing system warns the operator of an increase in web tension in addition to a web break if one has occurred. The system includes a sensing arm that is pivotally attached to the processor about a pivot point. An idler transport roller is rotatably attached to an end that extends into the film transport area of the processor and engages the photosensitive web such that movement of the web rotates the transport roller. The sensing arm at another end, on a side of the pivot point opposite from the transport roller, is biased in a direction opposing the tension caused by the moving photosensitive web over the transport roller. A tension detecting mechanism detects the movement of the sensing arm when the web tension increases such that the biasing force biasing the sensing arm is overcome. When the tension detecting mechanism detects the movement, a signal is transmitted indicating that an increase in web tension has occurred. A first detecting mechanism detects the rotation of the transport roller and transmits a signal when the roller stops rotating indicating that a web break has occurred.

BRIEF DESCRIPTION OF THE DRAWINGS

FIG. 1 is a perspective view of a cine processor which preferably includes the web break/web tension detection system of the present invention.

FIG. 2 is a sectional view along section 2—2 of FIG. 1.

FIG. 5 is a sectional view along section 5—5 of FIG. 2.

FIG. 6 is a sectional view along section 6—6 of FIG. 2.

DETAILED DESCRIPTION OF THE PREFERRED EMBODIMENTS

Figure 3:
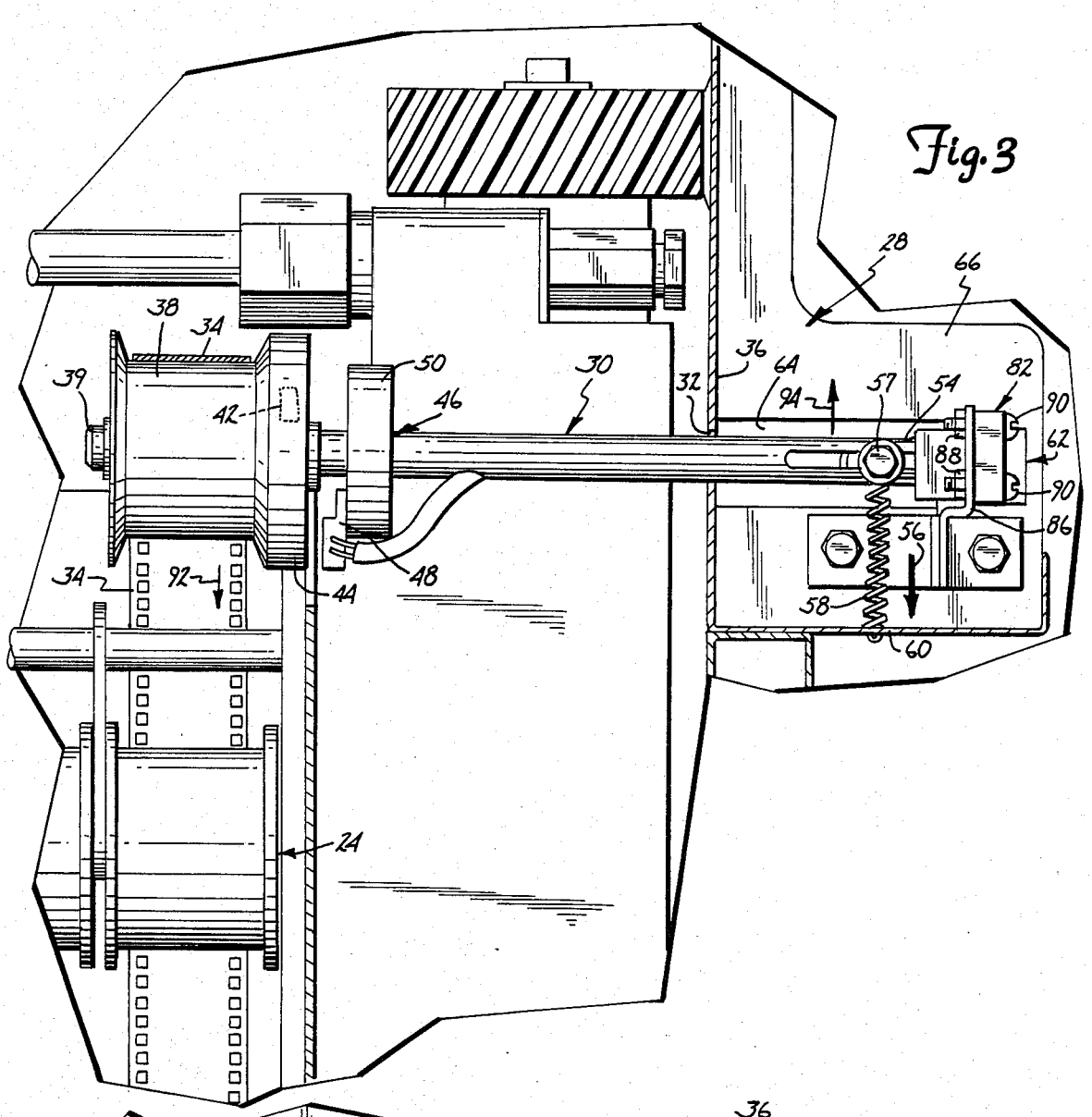
FIG. 3 is a sectional view along section 3—3 of FIG. 2.

FIG. 1 shows a typical cine processor, generally indicated at 10, for continuous processing of webs of photographic film. Photographic film is transported from a loader accumulator assembly 12, through a plurality of modular processing tanks 14, through a film dryer 16 and then to a takeup assembly 18. A wall 20 divides the modular processing tank 14 for processing photographic film such that the film is processed in the absence of natural light through some of the tanks 14.

The processing tanks 14 have various chemicals which process the photographic film. A photographic film 34 is transported through the various tanks 14 by transport racks 22, as illustrated in FIG. 2. The film 34 is threaded within each individual rack 22 from a first set of upper rollers 24 to a second set of lower rollers directly beneath the upper set of rollers 24 in a helical fashion. When all of the racks 22 in the tank 14 are threaded with film, the film 34 is transferred to the next tank 14 over tank walls 26.

As can be seen from the above description, a film break results in costly downtime and damage to the photosensitive film web 34. The present invention provides a manner for initially warning the operator when the film tension has increased above a predetermined value and then to warn the operator where and when a film break has occurred.

Figure 4:
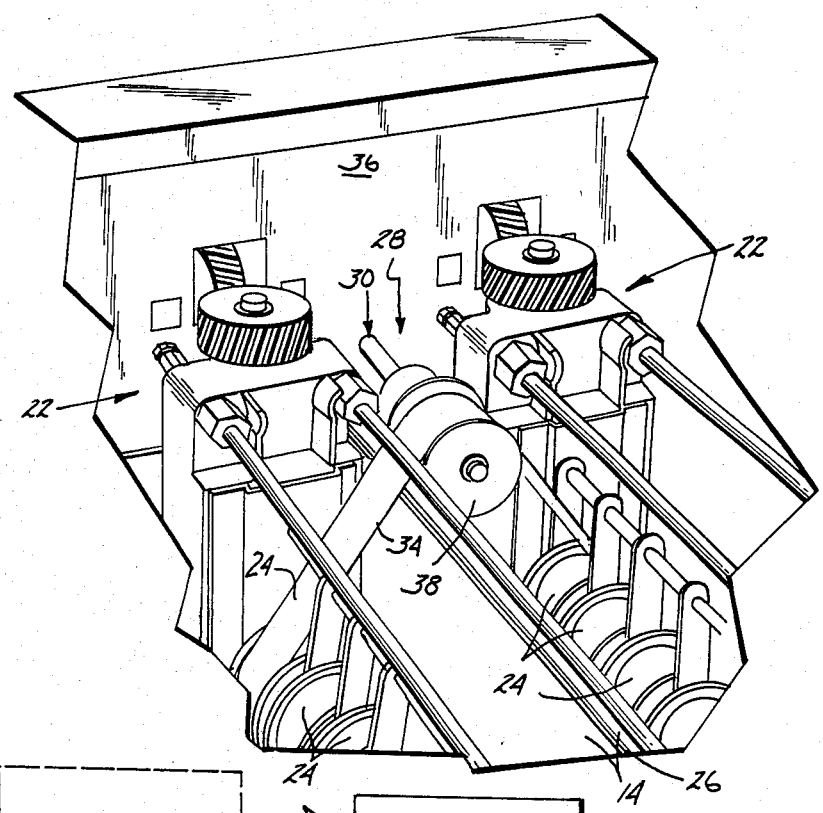
FIG. 4 is a fragmentary perspective view of the web break/web tension detector positioned between two racks.

A sensing device of the sensing system of the present invention is generally indicated at 28 in FIGS. 2, 3 and 4. The sensing system preferably includes a plurality of sensing devices 28 for sensing film tension and film breaks within the processing tanks 14 at various locations. The sensing devices 28 operate independently of each other, thus providing an indication of film tension and film breaks at separate locations.

The sensing device 28 includes a sensing arm 30 pivotally movable within an aperture 32 (see FIG. 3) positioned in a wall 36 of the processor 10. An idler transport roller 38 is rotatably attached to the sensing arm 30 proximate an end portion 39 positioned within the processor 10 such that the film 34 may be transported from one individual tank 14 to the next tank 14 using the transport roller 38 as shown in FIG. 4. The transport roller 38 is an idler roller freely rotating when engaging the film 34 as indicated by arrow 40 in FIG. 5.

Figure 9:
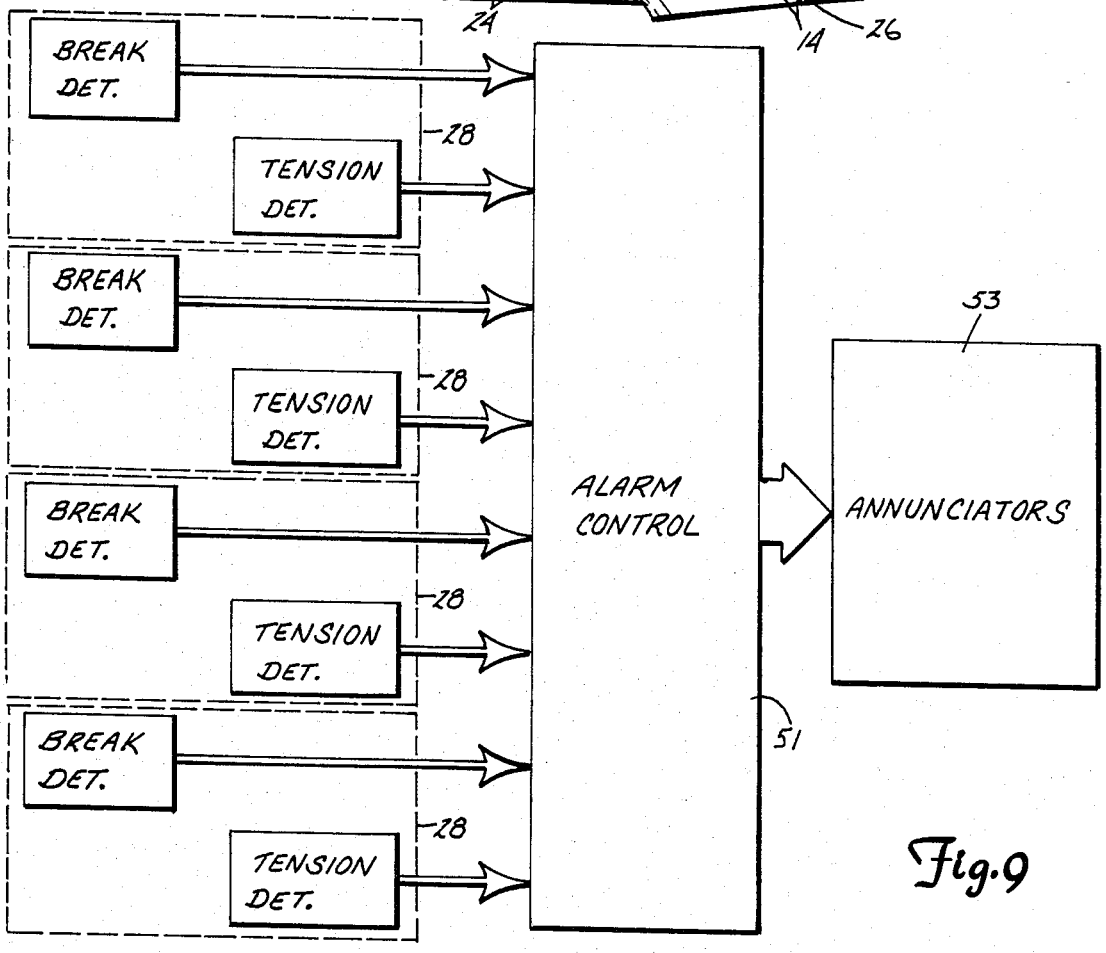
FIG. 9 is a diagrammatical view of the web break/-web tension alarm control system.

A ceramic magnet 42 is positioned within a rear flange 44 of the transport roller 38. A reed switch 48, as illustrated in FIGS. 2, 3 and 5, is fixedly attached to the shaft 30. The reed switch 48 is attached to a collar 50 by a pair of screws 52. The collar 50 in turn is fixedly attached to the shaft 30. The reed switch 48 is of conventional construction and typically has contacts mounted on ferromagnetic reeds sealed within a glass tube that are designed for actuation by an external magnetic field, such as the ceramic magnet 42 positioned within the transport roller 38. When the transport roller 38 is engaged and rotated by the film web 34, the ceramic magnet 42 passes by the reed switch 48 and magnetizes the reeds which attract each other and close the switch. An alarm control 51, as illustrated in FIG. 9, keeps track of the amount of time elapsed between switch closings and when the elapsed time exceeds a predetermined value, suitable circuitry activates a suitable annunciator 53 for warning the operator that a film break has occurred.

Figure 8:
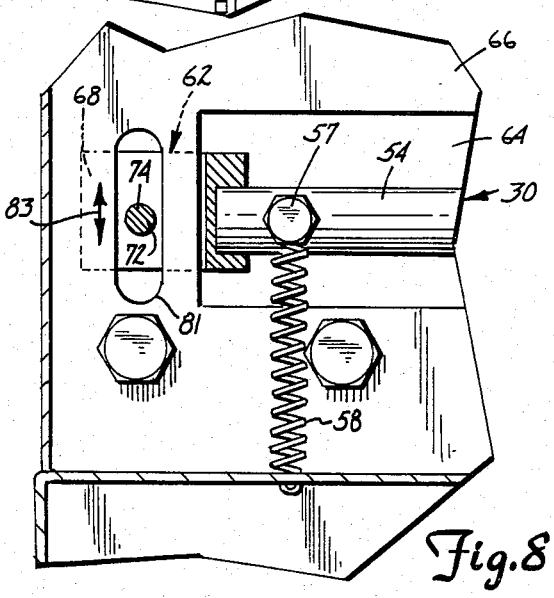
FIG. 8 is a sectional view along section 8—8 of FIG. 7.

The shaft 30 is biased at an end portion 54 in a direction of arrow 56, as illustrated in FIG. 3. Preferably, the shaft 30 is biased by a pair of coil springs 58 attached at one end to a fixed portion 60 of the processor frame and at another end to the end portion 54 of the shaft with a bolt 57, as illustrated in FIGS. 2, 3 and 8. The coil springs 58 bias the shaft 30 about the aperture 32 in a direction opposing the film tension created by the film 34 engaging the transport roller 38. In other words, the tension of film 34 tends to pull roller 38 downward and raise end portion 54 of shaft 30. The bias force of springs 58 tends to pull end portion 54 downward and raise roller 38.

Figure 7:
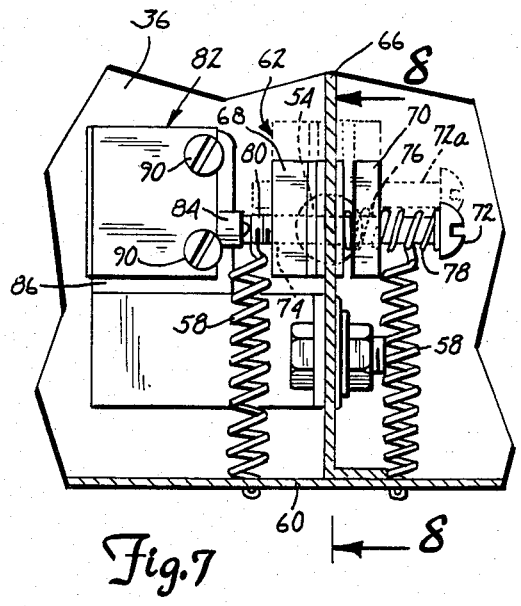
FIG. 7 is a sectional view along section 7—7 of FIG. 3.

A U-shaped member 62 is fixedly attached to the shaft 30 proximate the coil springs 58. The portion 54 of the shaft 30 and the U-shaped member 62 pivot within an opening 64 of a substantially upright wall section 66 of the processor as illustrated in FIG. 7. The U-shaped member 62 has a pair of legs 68, 70 which are spaced apart with a portion of the wall 66 therebetween as shown in FIGS. 2 and 7. The legs 68, 70 pivot on opposite sides of the wall section 66. A bolt 72 is threadably inserted within aligned threaded apertures 74, 76 located in legs 68, 70, respectively. The leg 68 is biased toward the wall 66 by the coil spring 78. The coil spring 78 fixes a position of the U-shaped member 62 to maintain parallel alignment of the transport roller 38 with respect to the upper rack rollers 24. The coil spring 78 also keeps the contact pressure between the leg 68 and the wall 66 at a controlled level.

A distal end 80 of the bolt 72 engages a switching mechanism 82 that is attached in a suitable manner to the frame of the processor in a stationary position relative to the movement of the bolt 72, as illustrated in FIG. 7. The bolt 72 extends through a slot 81 in wall portion 66, which permits movement of the bolt 72 and shaft end 54 in the general direction indicated by arrow 83 in FIG. 8. The switching mechanism 82 is preferably a microswitch having a switching member 84 that is engaged by the distal end 80 and is secured to a stationary bracket 86 with nuts 88 and bolts 90.

The film tension, as indicated by arrow 92 in FIG. 3, pivots the end 54 of the shaft 30 in a direction of arrow 94. The bias force of the bias springs 58 oppose the film tension 92, as indicated by arrow 56, such that the distal end 80 of the bolt 72 is in contact with the switching member 84. When the bolt 72 is in contact with the switching member 84, the tension on film web 34 has a normal or desired value for processing of the film through the cine processor 10. However, when the film tension increases within the processor 10 and becomes greater than the bias force of the bias springs 58, the bolt 72 moves to the position illustrated by broken lines 72*a*. With the bolt 72 positioned at 72*a*, the distal end 80 is no longer in a contact relationship with the switching member 84 and consequently the microswitch 82 closes and warns the operator through suitable circuitry that the tension has increased to a potentially dangerous level.

During the increase in tension, the film 34 has been in contact with the idler transport roller 38, freely rotating the idler transport roller 38. If the film tension increases to a level that causes a film break within the processor 10, the transport roller 38 will stop rotating, indicating that a film break has occurred. Since the film tension and film break detection system of the present invention includes a plurality of detector devices 28, the location of a film break or the increase in tension is easily determined by suitable circuitry and warning system indicating to the operator where the problem is occurring.

CONCLUSION

The present invention is an improved sensing system that senses web tension and web movement of a photosensitive web through a cine processor. The sensing system warns the operator of an increase in web tension and when the web tension reaches a level at which a web break may be imminent and if a break occurs the sensing system warns the operator that a break has occurred. In addition, the system provides a method to determine the location of web tension increases or film breaks within the processor. The system of the present invention can also be used not only in the tanks but throughout the processor including such sections as the dryer 16.

Although the present invention has been described with reference to preferred embodiments, workers skilled in the art will recognize that changes may be made in form and detail without departing from the spirit and scope of the invention.

What is claimed is:

1. An apparatus for sensing both web movement and web tension of a photosensitive web moving through a photographic processor, the apparatus sensing both web movement and web tension through a singular contact with the photosensitive web, the processor having a frame structure, the apparatus comprising:

a longitudinal sensing arm pivotally attached to the processor about a pivot point and having a first end and a second end;

a single roller for engaging the photosensitive web and rotatably attached to the first end of the sensing arm such that movement of the web rotates the roller, the roller including a magnet positioned within the roller such that the magnet rotates with the roller;

a first stationary magnetically actuated switch disposed on the sensing arm such that the first stationary magnetically actuated switch is actuated by the magnet each time the magnet passes the switch due to contact of the film with the single roller;

alarm control means for measuring the time between actuations of the first switch and comparing the time to a predetermined value such that when the time between said first switch actuations is greater than the predetermined value an alarm is actuated;

a coil spring attached at one end to the second end of the sensing arm on a side of the pivot point opposite from the roller and at another end to a stationary part of the photographic processor, biasing the arm against a tension force caused by the film contacting the roller; and a second stationary switch positioned proximate the second end of the sensing arm such that the second switch is actuated by movement of the sensing arm due to contact of the film with the single roller when the tension force caused by the film becomes greater than the biasing force of the spring such that both web movement and web tension are detected by contact of the film with the single roller.

2. In a photographic processor an improved sensing system including a plurality of sensing devices for sensing web movement and web tension of a photosensitive web moving through the photographic processor, each sensing device sensing both web movement and web tension through a singular contact with the photosensitive web, each sensing device comprising:

a longitudinal sensing arm pivotally attached to the processor about a pivot point and having a first end and a second end;

a single roller for engaging the photosensitive web and rotatably attached to the first end of the sensing arm such that movement of the web rotates the roller, the roller including a magnet positioned within the roller such that the magnet rotates with the roller;

a first stationary magnetically actuated switch disposed on the sensing arm such that the first stationary magnetically actuated switch is actuated by the magnet each time the magnet passes the switch due to contact of the film with the single roller;

alarm control means for measuring the time between actuations of the first switch and comparing the time to a predetermined value such that when the time between said first switch actuations is greater than the predetermined value an alarm is actuated;

a coil spring attached at one end to the second end of the sensing arm on a side of the pivot point opposite from the roller and at another end to a stationary part of the photographic processor, biasing the arm against a tension force caused by the film contacting the roller; and a second stationary switch positioned proximate the second end of the sensing arm such that the second switch is actuated by movement of the sensing arm due to contact of the film with the single roller when the tension force caused by the film becomes greater than the biasing force of the spring such that both web movement and web tension are detected by contact of the film with the single roller.

* * * * *